US005961348A

United States Patent [19]

Murphy

[11] Patent Number: 5,961,348

[45] **Date of Patent: *Oct. 5, 1999**

[54] SYSTEM FOR TERMINATING THE SHIELD OF A HIGH SPEED CABLE

[75] Inventor: Paul Murphy, Naperville, Ill.

[73] Assignee: Molex Incorporated, Lisle, Ill.

[ * ] Notice: Under 35 U.S.C. 154(b), the term of this patent shall be extended for 18 days.

[21] Appl. No.: 08/609,303

[22] Filed: Mar. 1, 1996

[51] Int. Cl.[6] ..... H01R 9/05

[52] U.S. Cl. ..... 439/579; 439/610; 439/108

[58] Field of Search ..... 439/579, 497, 439/608, 866, 874, 875, 877, 108

[56] References Cited

U.S. PATENT DOCUMENTS

| | | | |
|---|---|---|---|
| 3,916,139 | 10/1975 | Schantz | 439/877 |
| 4,966,565 | 10/1990 | Dohi | 439/874 |
| 5,190,473 | 3/1993 | Mroczkowski et al. | 439/580 |
| 5,197,893 | 3/1993 | Morlion et al. | 439/101 |
| 5,241,135 | 8/1993 | Fetzer | 174/88 |
| 5,304,069 | 4/1994 | Brunker et al. | 439/108 |
| 5,495,075 | 2/1996 | Jonckheere et al. | 174/74 |
| 5,785,555 | 7/1998 | O'Sullivan et al. | 439/610 |
| 5,823,825 | 10/1998 | Murphy | 439/610 |

FOREIGN PATENT DOCUMENTS 2 718 299 A1 6/1995 France .

*Primary Examiner*—Paula Bradley
*Assistant Examiner*—Tho Dac Ta
*Attorney, Agent, or Firm*—Charles S. Cohen

[57] ABSTRACT

A terminal is disclosed for terminating the shield of a high speed cable having an outer jacket and an inner metallic shield with a portion of the outer jacket removed to expose a portion of the metallic shield. The terminal includes a ground plate portion. A loop projects from the ground plate portion for receiving the high speed cable at a location along the cable in registry with the exposed metallic shield thereof. A solder connection is established between the metallic shield and the loop.

26 Claims, 4 Drawing Sheets

SYSTEM FOR TERMINATING THE SHIELD OF A HIGH SPEED CABLE

SPECIFICATION

1. Field of the Invention

This invention generally relates to the art of electrical connectors and, particularly, to a system for terminating the metallic shield of a high speed cable, such as the metallic braid of the cable.

2. Background of the Invention

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering. Other systems use crimping procedures to crimp at least a portion of the terminating member securely to the metallic braid for commoning purposes.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order 0.012 inch. Coaxial cables having even smaller dimensional parameters have been used.

The problems in terminating such very small coaxial cables often revolve around terminating the metallic shield of the cable. For instance, if soldering methods are used, applying heat (necessary for soldering) in direct proximity to the metallic shield can cause heat damage to the underlying inner dielectric and, in fact, substantially disintegrate or degrade the inner dielectric. If conventional crimp-type terminations are used, typical crimping forces often will crush or deform the inner dielectric surrounding the center conductor/core of the cable.

The above problems are further complicated when the metallic shield of the high speed cable is not terminated to a cylindrical terminating member, but the shield is terminated to a flat terminating member or contact. For instance, it is known to terminate the tubular metallic shield or braid of a coaxial cable to a flat ground circuit pad on a printed circuit board. This is accomplished most often by simply gathering the tubular metallic braid of the coaxial cable into a twisted strand or "pigtail" which, in turn, is soldered to the flat ground pad on the circuit board.

Another example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module.

In terminating the tubular metallic shields or braids of high speed cables to flat ground contact pads as in a printed circuit board, or to a planar ground plate as in the above-referenced U.S. patent, or to any other flat or non-tubular terminating member, various design considerations should be considered as has been found with the present invention. It should be understood that there is a transition zone created where the center conductor/core of the high speed cable goes from a "controlled environment" wherein the conductor/core is completely surrounded by the tubular metallic shield or braid, to an "uncontrolled environment" where the braid is spread away from the conductor/core for termination to the non-tubular terminating member. It is desirable that this transition zone be held to as small an area as possible and as short a length (i.e., longitudinally of the cable) as possible. Preferably, the metallic shield or braid should be terminated over an area (or at least at two points) approximately 180° apart in relation to the center conductor/core of the cable. Preferably, the flat terminating member should overlap or at least extend to the point where the metallic shield or braid is separated from its tubular configuration surrounding the conductor/core of the cable. Still further, it is desirable that the metallic shield or braid of any given high speed cable be terminated on the same side of the flat terminating member as the center conductor/core of the cable.

The present invention is directed to solving the above-identified problems and satisfying as many of the above-identified design parameters as possible in an improved system for terminating the metallic shield of a high speed cable to a terminating member, such as a ground plate.

SUMMARY OF THE INVENTION

An object, therefore, of the invention is to provide a new and improved system or terminal for terminating the metallic shield of a high speed cable.

In the exemplary embodiment of the invention, at least one high speed cable is prepared by removing a portion of the outer jacket of the cable to expose a portion of the metallic shield of the cable. The terminal includes a conductive ground plate portion. A loop projects from one side of the ground plate portion and defines an internal passage for receiving the cable at a location along the cable in registry with the exposed metallic shield thereof. A solder connection is provided between the metallic shield and the ground plate portion at the loop.

As disclosed herein, the terminal is stamped and formed of conductive sheet metal material, with the ground plate portion being generally planar, and with the loop being formed out of the ground plate portion. The loop may be provided with a circumferentially extending slot, and the solder connection may be located substantially within the slot.

The preferred embodiment of the invention includes a pair of the loops on each opposite side of the ground plate portion for receiving a pair of high speed cables in a generally parallel side-by-side relationship on both opposite sides of the ground plate portion. Therefore, the terminal can terminate the metallic shields of four generally parallel cables.

A typical cable includes a dielectric inside the metallic shield. In an alternate method of using the invention, the solder connection is located between the metallic shield and the loop on the outside of the loop, with the dielectric disposed inside the loop.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
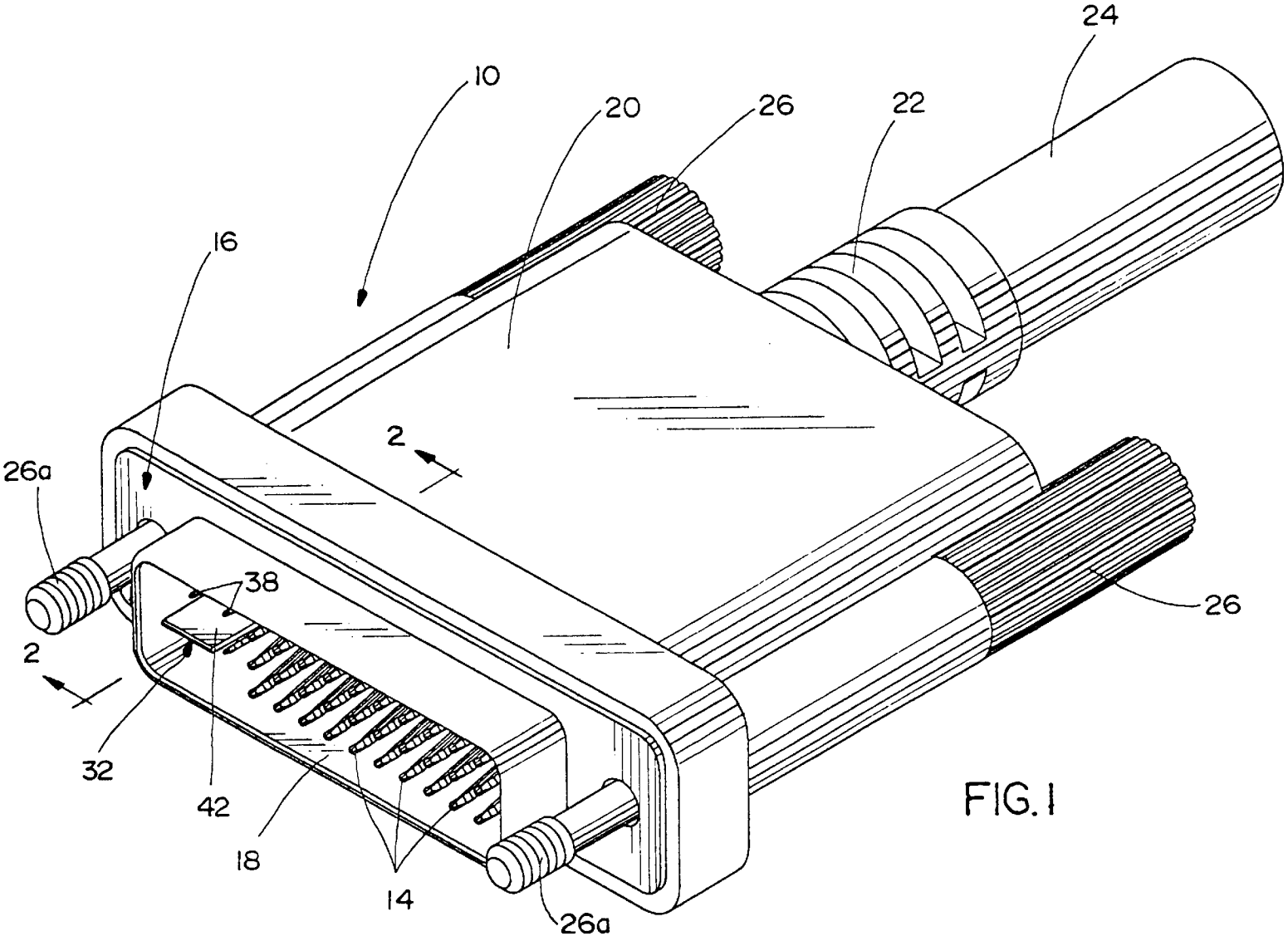
FIG. 1 is a perspective view of an electrical connector of a type in which the invention is applicable.
Figure 2:
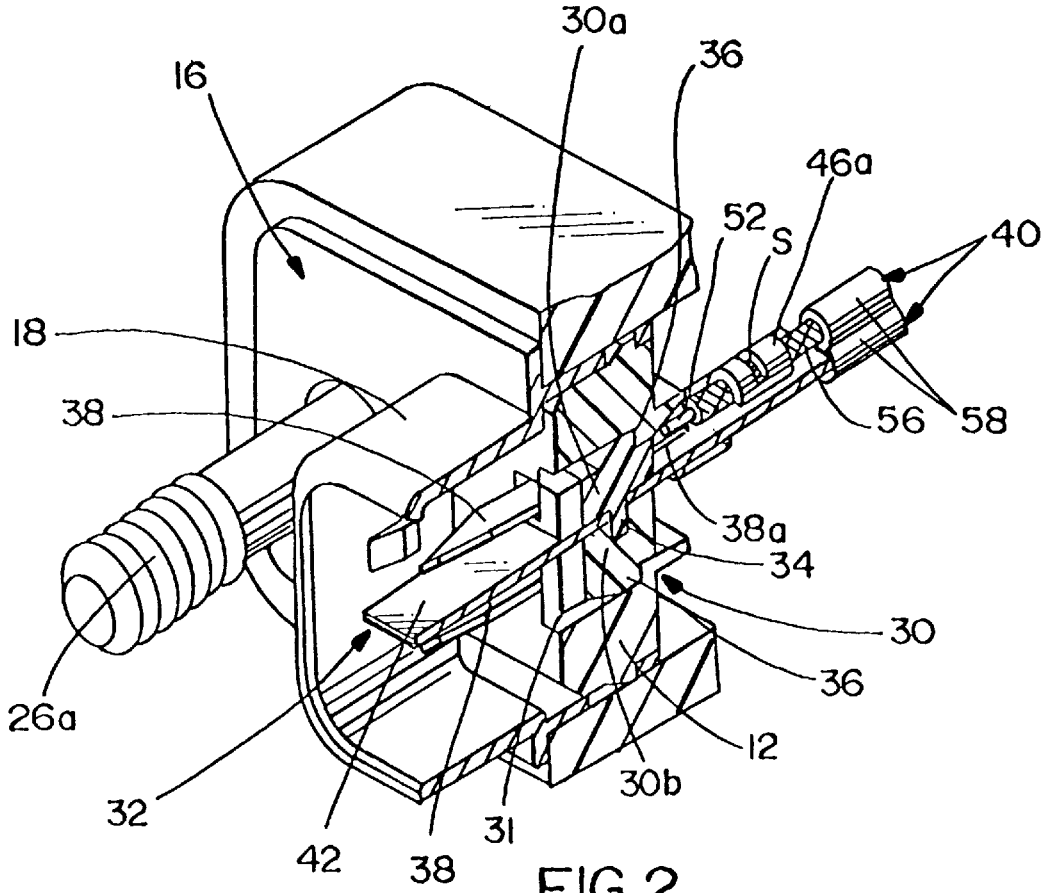
FIG. 2 is a fragmented vertical section taken generally along line 2—2 of FIG. 1.

Referring to the drawings in greater detail, and first to FIGS. 1 and 2, the invention is embodied in a shielded electrical connector, generally designated 10, which is a hybrid electrical connector for terminating both the conductors of slower data transmission lines and the conductors of high speed or high frequency transmission lines. In particular, electrical connector 10 includes a dielectric housing 12 (FIG. 2) mounting a plurality of data transmission terminals 14 (FIG. 1). A conductive shield, generally designated 16, substantially surrounds dielectric housing 12 and has a shroud portion 18 projecting forwardly about the mating ends of data transmission terminals 14. A two-piece backshell (not shown) substantially in conformance with that shown in U.S. Pat. No. 5,358,428, dated Oct. 25, 1994, projects rearwardly of housing 12 and shield 16. An overmolded boot 20 includes an integral cable strain-relief 22 that is in engagement with a composite electrical cable 24 which includes both the data transmission lines and the high speed or high frequency transmission lines. A pair of thumb screws 26 project through the overmolded boot and include externally threaded forward distal ends 26*a* for securing the connector to a complementary mating connector, panel or other structure.

As seen best in FIG. 2, a high speed signal transmission terminal module, generally designated 30, is inserted into a passage 31 in dielectric housing 12 from the rear thereof. The terminal module includes a pair of identical terminal blocks 30*a* and 30*b* which clamp a ground plate, generally designated 32, therebetween. Each terminal block includes a post 34 and a recess. The post from each terminal block extends from each terminal block through a hole or slot 44 (FIG. 3) in the ground plate and into a recess in the other terminal block to secure terminal blocks 30*a* and 30*b* to ground plate 32 as a subassembly. Once this subassembly is inserted into passage 31 in housing 12 as shown in FIG. 2, the terminal blocks are effective to clamp the ground plate therebetween. The terminal module is held within the dielectric housing by ramped latches 36 on each terminal block.

Each terminal block 30*a* and 30*b* is overmolded about at least one high speed signal terminal 38. The contact ends of a pair of the terminals 38, along with the forward end of ground plate 32, are shown projecting forwardly of the connector in FIG. 1, within the surrounding shroud portion 18 of shield 16. The rear ends 38*a* of terminals 38 (FIG. 9) are terminated to the center conductor/cores 52 of a plurality of coaxial cables, generally designated 40 in FIG. 2. The invention is particularly directed to the manner of termination of the metallic shields of the coaxial cables to ground plate 32, as described below.

Figure 3:
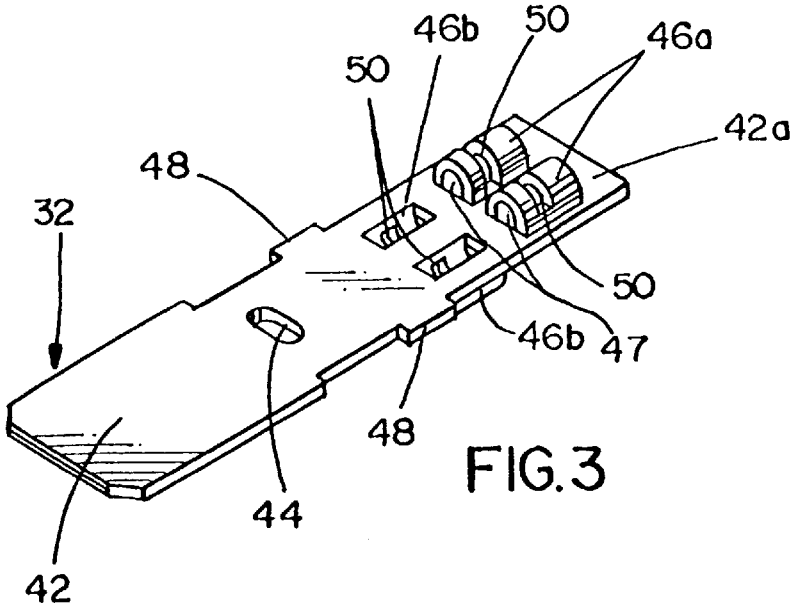
FIG. 3 is a perspective view of the stamped and formed metal terminal or ground plate.

More particularly, FIG. 3 shows ground plate 32 stamped and formed from conductive sheet metal material. The ground plate includes an elongated, generally planar leg or stem portion 42 which will form a blade portion for ground plate 32. The blade portion includes aperture 44 through which posts 34 (FIG. 2) of terminal blocks 30*a* and 30*b* extend. Two pairs of loops or tunnels 46*a* and 46*b* are formed at a terminating end 42*a* of blade portion 42. As viewed in FIG. 3, the pair of loops 46*a* can be considered the upper loops, and the pair of loops 46*b* can be considered the lower loops. Loops 46*a* are closer to terminating end 42*a* than loops 46*b*. Barbs or teeth 48 are stamped at the opposite edges of blade portion 42 to facilitate holding the subassembly of the ground plate and terminal blocks 30*a* and 30*b* within the housing. Finally, each loop may be provided with a circumferentially extending slot 50 for soldering purposes as described hereinafter.

Figure 4:
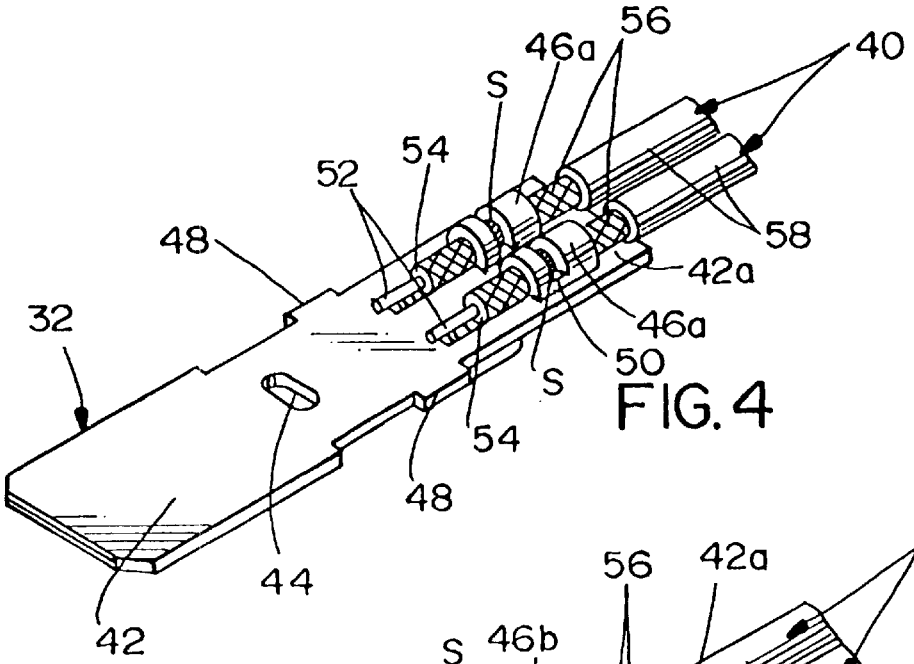
FIG. 4 is a perspective view of the ground plate receiving one pair of coaxial cables on one side thereof.
Figure 5:
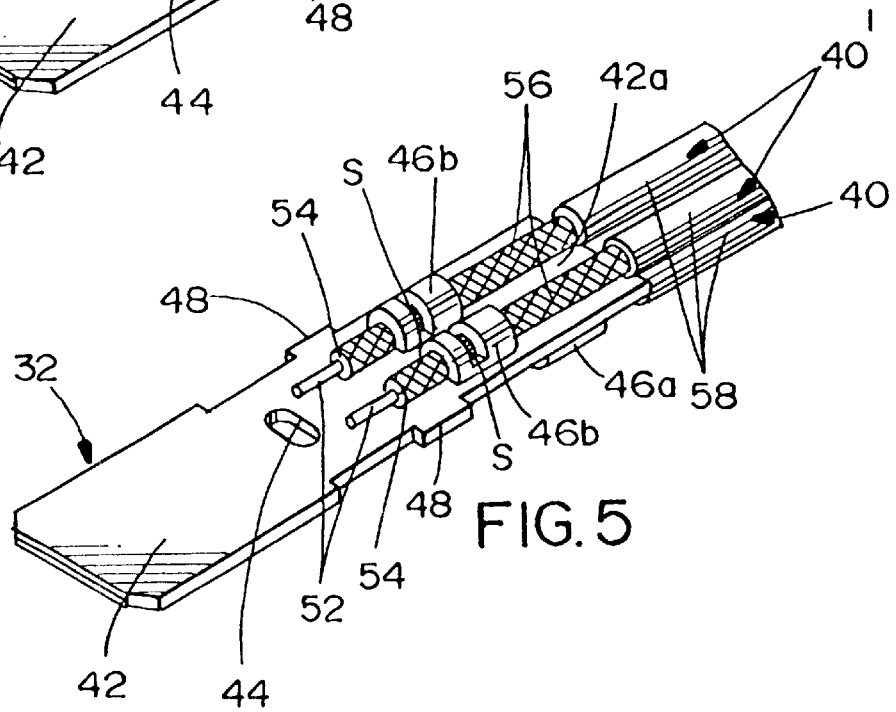
FIG. 5 is a view similar to that of FIG. 4, but showing the ground plate inverted and with a second pair of coaxial cables received on the opposite side thereof.

Referring to FIGS. 4 and 5, once formed, ground plate 32 is provided with a pair of loops 46*a* and 46*b* projecting from each opposite side of blade portion 42. The loops define internal passages 47 for positioning a pair of coaxial cables in a generally parallel side-by-side relationship on both opposite sides of the ground plate. One pair of loops 46*a* is located near the extreme rear distal end of blade portion 42, and the other pair of loops 46*b* is located slightly spaced longitudinally forward of the first pair toward the leading edge of ground plate 32. With this structure, the ground plate can terminate from one to four coaxial cables depending on the specifications of the connector. In some computer applications, three cables may be used to carry the red, green and blue chroma signals for a monitor. A fourth cable might be used for flat screen monitors for carrying the pixel clock timing signals.

FIG. 4 shows a pair of coaxial cables 40 positioned on ground plate 32. At this point, it should be understood that each coaxial cable 40 is of a conventional construction in that each cable includes a center conductor or core 52 surrounded by a tube-like inner dielectric material 54. A metallic shield in the form of a tubular metallic braid 56 surrounds inner dielectric 54. An insulating jacket 58, as of plastic or the like, surrounds metallic braid 56 to form the overall composite coaxial cable 40.

Figure 9:
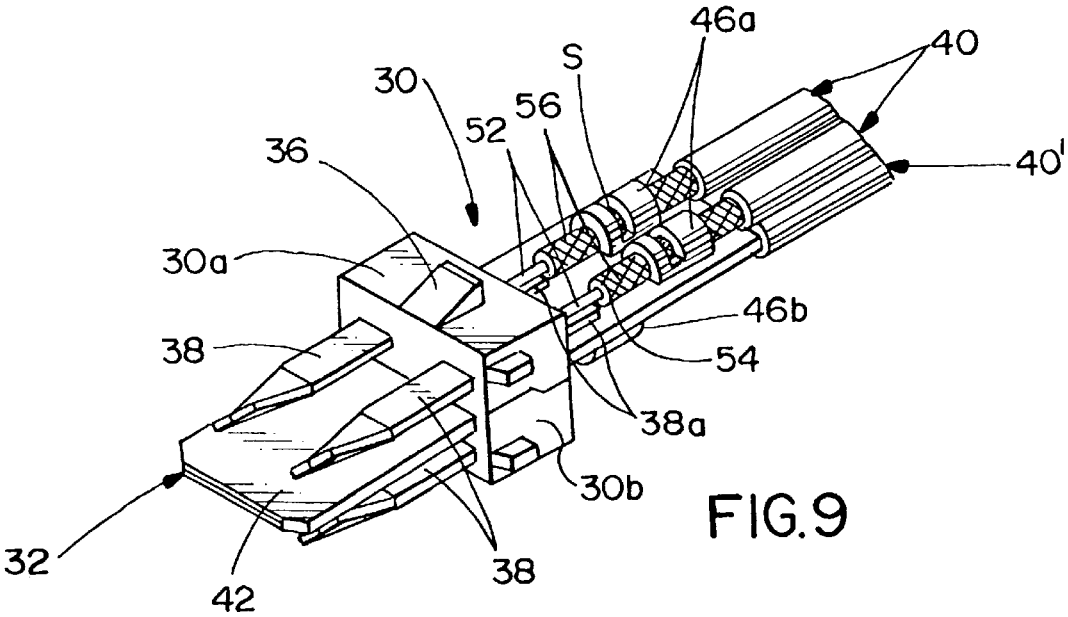
FIG. 9 is a perspective view of the terminal module mountable in the connector of FIGS. 1 and 2.

FIG. 4 shows that center conductor/core 52 of each coaxial cable 40 has been stripped to expose a given length thereof which will be soldered, welded or otherwise secured to the inner ends 38*a* of high speed signal transmission terminals 38 (FIGS. 2 and 9). The outer insulating jacket 58 of each cable also has been cut-back to expose a given length of the respective metallic shield 56. Therefore, the exposed shield can be soldered to a respective one of the loops 46*a* (or 46*b*) of ground plate 32 as discussed below. FIG. 4 shows a pair of the prepared coaxial cables 40 inserted in proper alignment within loops 46*a* at a location along the cables whereby the loops are in registry with or surround the exposed metallic shields of the cables.

Ground plate 32 then is mechanically and electrically connected to metallic shields 56 of the pair of coaxial cables 40 by soldering the metallic shields to loops 46*a* by applying solder at an interface between the loops and the shields.

When soldering shields 56 to ground plate 32, it is desirable to use a soldering iron having a relatively small tip. As stated above, loops 46*a* and 46*b* may be provided with circumferentially extending slots 50. The soldering process can be carried out by applying solder through the slots, as at "S" in FIG. 4. Although it is desirable to dimension each slot wide enough to facilitate adequate solder flow throughout the slot, each slot should be narrow enough to prevent the relatively small tip of the soldering iron from contacting the braid of shield 56 of the cable, which could result in damage to the underlying dielectric 54. Each slot is on the order of approximately 0.040 inch wide, although it is believed that such slot could be within the range of 0.010 to 0.0110 inch wide. The slots should be sufficiently narrow to at least prevent whatever soldering iron or tool is used from passing through the slots and into direct engagement with the metallic shields. Such engagement may result in damaging the underlying dielectric. In essence, the slots restrict the amount of soldering heat which is transmitted inwardly to the dielectric, on the other hand, with the slots extending in a circumferential direction, the slots provide a large circumferential area of access to the metallic shields in a circumferential direction. Preferably, the slots extend at least approximately 180° around the respective coaxial cables.

Figure 6:
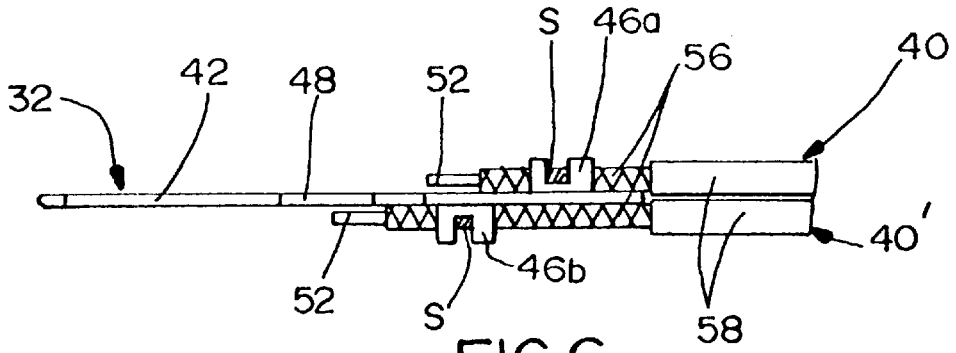
FIG. 6 is a fragmented side elevational view subassembly of FIG. 5.

After the pair of coaxial cables 40 are solder connected within the top pair of loops 46*a* as shown in FIG. 4 and described above, ground plate 32 is inverted or flipped-over as shown in FIGS. 5 and 6 so that the forwardmost loops 46*b* are facing upwardly. A second pair of coaxial cables 40' are inserted and solder connected within loops 46*b* by repeating the steps described above in relation to solder connecting cables 40 within loops 46*a*.

Figure 7:
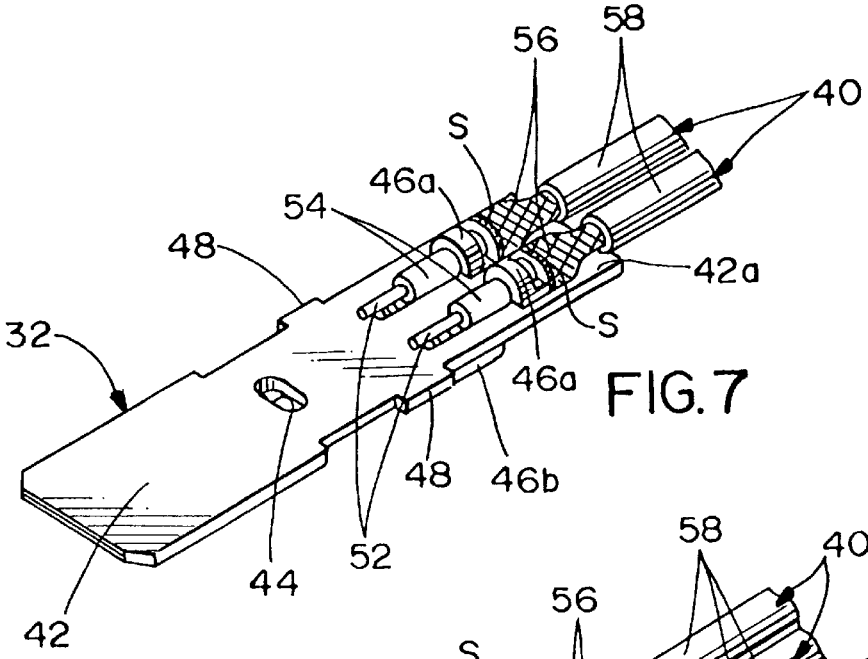
FIG. 7 is a view similar to that of FIG. 4, but showing an alternative system wherein the metallic shields of the cables are fanned out over the tops of the loops.
Figure 8:
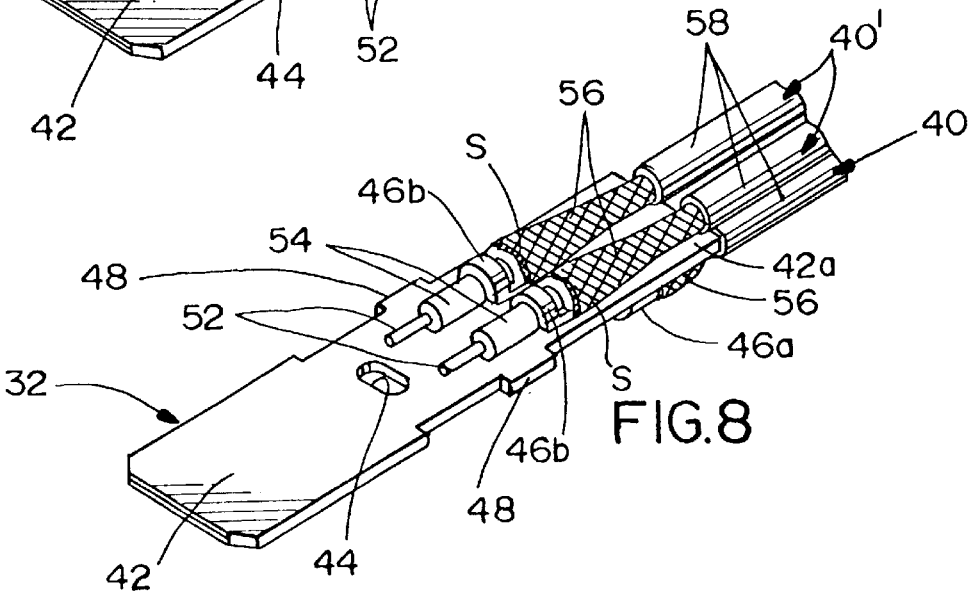
FIG. 8 is a view similar to that of FIG. 6, but showing the system of FIG. 7.

FIGS. 7 and 8 correspond generally to FIGS. 4 and 5 but show an alternative method of using the system of the invention. In the alternative embodiment of FIGS. 7 and 8, metallic shields 56 are fanned out over the outsides of loops 46*a* and 46*b* and are solder connected to the loops, as at "S". When the coaxial cables are inserted into the loops, in essence, the inner dielectrics 54 of the cables are disposed inside the loops, and the metallic shields 56 of the cables are fanned out over the outside of the loops. Therefore, the loops not only position the cables on the ground plates, but the loops perform a dual function of protecting the dielectrics from the heat of soldering. Preferably, each shield is fanned out over its respective loop approximately 180° about the respective cable.

Once the subassembly of FIG. 5 (or the subassembly of FIG. 8) is fabricated, including the soldering procedures, this subassembly is assembled to terminal blocks 30*a* and 30*b* including high speed signal transmission terminals 38 to form terminal module 30 as shown in FIG. 9 and described above in relation to FIG. 2. Center conductors/cores 52 of the coaxial cables are then connected, as by soldering, welding or otherwise securing to the inner ends 38*a* of terminals 38, while terminal blocks 30*a* and 30*b* clamp blade portion 42 of ground plate 32 therebetween, as shown in FIG. 2 and described above. The terminal module then is mounted within dielectric housing 12 as shown in FIG. 2. If desired, terminal blocks 30*a* and 30*b* could be mounted to blade portion 42 of ground plate 32 prior to inserting cables 40 and 40' into loops 46*a* and 46*b*, respectively. In such case, ground plate 32 would have the terminal blocks mounted thereon at the beginning of the termination process.

In the alternative, it is believed that by using a coaxial cable having an inner dielectric that can withstand relatively high temperatures without deformation or degradation (such as aerated Teflon®), it may be possible to eliminate the slots 50 within loops 46*a* and 46*b*. In such case, solder would be applied along the leading or trailing (or both) edges of the loops where they contact the shields 56. In still another alternate embodiment, the loops would not include slots 50 and some means on the inner surface of the loops would be provided for applying solder between the loops and the shields. Such means could include a tin/lead plating, a solder top coat or a solder inlay. The outer surface of the loops would be heated with a soldering iron or other tool, which would cause the plating, solder top coat or solder inlay to flow, interconnecting the inner surface of the loops and the metallic shields.

The concepts of the invention have been shown and described herein in conjunction with terminating the metallic shield of the coaxial cable to a terminating member 32 in the form of a ground plate 42. However, it should be understood that the concepts of the invention are equally applicable for terminating the metallic shield 56 to other types of terminating members, such as individual electrical terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector for termination to a pair of cables each of which includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least some of said terminal receiving passages; and a generally planar metal ground member disposed in said housing relative to said terminals, said ground member including a termination portion for terminating said exposed portion of said metallic shield of each of said cables to said ground member, said termination portion including a pair of loops formed out of said ground member with each of said loops configured for receiving said exposed portion of said metallic shield of one of said cables within said loop so that said metallic shield can be bonded to said ground member while said exposed portion is within said loop.

2. The electrical connector of claim 1 wherein each of said loops includes a slot used in bonding said metallic shield disposed within said loop to said ground member.

3. The electrical connector of claim 2 wherein each of said slots is a circumferentially extending slot extending through a substantial portion of said loop.

4. The electrical connector of claim 1 including at least one additional cable to be terminated to said termination portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination portion of said ground member includes a pair of additional loops extending from a side of the termination portion opposite from the side on which said pair of loops extends, at least one of said additional loops configured for receiving said additional exposed portion of said additional metallic shield of said additional cable within said additional loop so that said additional metallic shield can be bonded to said ground member while said additional exposed portion is within said additional loop.

5. The electrical connector of claim 4 wherein said termination portion and each of said loops form an opening that is dimensioned to generally encircle said exposed portion of said metallic shield of each of said cables and wherein said termination portion and at least one of said additional loops form an additional opening that is dimensioned to generally encircle said additional exposed portion of said additional metallic shield of said additional cable.

6. The electrical connector of claim 4 wherein each of said loops includes a slot used in bonding said metallic shield disposed within said loop to said ground member and wherein each of said additional loops includes an additional slot used in bonding said additional metallic shield disposed within said additional loop to said ground member.

7. An electrical connector for termination to a cable which includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least some of said terminal receiving passages; and a generally planar metal ground member disposed in said housing relative to said terminals, said ground member including a termination portion for terminating said exposed portion of said metallic shield of said cable to said ground member, said termination portion including a loop formed out of said ground member with said loop configured for receiving said exposed portion of said metallic shield of said cable within said loop so that said metallic shield can be bonded to said ground member while said exposed portion is within said loop.

8. The electrical connector of claim 7 wherein said loop includes a slot used in bonding said metallic shield disposed within said loop to said ground member.

9. The electrical connector of claim 8 wherein said slot is a circumferentially extending slot extending through a substantial portion of said loop.

10. The electrical connector of claim 7 including at least one additional cable to be terminated to said termination portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination portion of said ground member includes an additional loop extending from a side of the termination portion opposite from the side on which said loop extends, said additional loop configured for receiving said additional exposed portion of said additional metallic shield of said additional cable within said additional loop so that said additional metallic shield can be bonded to said ground member while said additional exposed portion is within said additional loop.

11. The electrical connector of claim 10 wherein said termination portion and said loop form an opening that is dimensioned to generally encircle said exposed portion of said metallic shield of said cable and wherein said termination portion and said additional loop form an additional opening that is dimensioned to generally encircle said additional exposed portion of said additional metallic shield of said additional cable.

12. The electrical connector of claim 10 wherein said loop includes a slot used in bonding said metallic shield disposed within said loop to said ground member and wherein said additional loop includes an additional slot used in bonding said additional metallic shield disposed within said additional loop to said ground member.

13. A termination assembly comprising:

a pair of cables each having an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a conductive member having a termination portion, said conductive member being at least partially disposed in a dielectric housing of an electrical connector; and a pair of loops projecting from said termination portion, each of said loops defining an internal passage for receiving one of said cables at a location along said cable in registry with said exposed portion of said metallic shield.

14. The termination assembly of claim 13 wherein each of said loops includes a slot used in bonding said metallic shield disposed within said loop to said termination portion.

15. The termination assembly of claim 13 wherein said termination portion and each of said loops form an opening that is dimensioned to generally encircle said exposed portion of said metallic shield of one of said cables disposed within said loop.

16. The termination assembly of claim 13 including at least one additional cable terminated to said termination portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and said termination portion of said conductive member includes a pair of additional loops extending from a side of said termination portion opposite from the side on which said pair of loops extends, at least one of said additional loops configured for receiving said additional exposed portion of said additional metallic shield of said additional cable within said additional loop so that said additional metallic shield can be bonded to said termination portion while said additional exposed portion is within said additional loop.

17. The termination assembly of claim 16 wherein said termination portion is an elongated ground plate and wherein said pair of loops are spaced longitudinally along said ground plate with respect to said pair of additional loops.

18. The termination assembly of claim 16 wherein said termination portion and each of said loops form an opening that is dimensioned to generally encircle said exposed portion of said metallic shield of each of said cables and wherein said termination portion and at least one of said additional loops form an opening that is dimensioned to generally encircle said additional exposed portion of said additional metallic shield of said additional cable.

19. The termination assembly of claim 16 wherein each of said loops includes a slot used in bonding said metallic shield disposed within said loop to said conductive member and wherein each of said additional loops includes an additional slot used in bonding said additional metallic shield disposed within said additional loop to said conductive member.

20. A method of terminating a pair of cables each having a inner conductor, an inner dielectric surrounding at least a portion of said inner conductor, a metallic shield surrounding at least a portion of said inner dielectric and an outer insulating jacket surrounding at least a portion of said metallic shield to an electrical connector having a dielectric housing with a mating face, a termination face and a plurality of terminal receiving passages between said mating face and said termination face and having a ground member secured within said housing, said ground member including a mating portion generally adjacent said mating face and a ground termination portion generally adjacent said termination face, comprising the steps of:

providing said cables with a portion of said outer insulating jacket of each of said cables being removed from about said metallic shield so as to expose an exposed portion of said metallic shield;

positioning said exposed portion of said metallic shield of each of said cables within one of a pair of loops extending from said ground member, each of said loops being configured in a generally arc-shaped configuration to define a cable receiving area; and bonding said exposed portion of said metallic shield to said ground member while said exposed portion is positioned in said loop.

21. The method of claim 20 wherein each of said loops includes a slot used in bonding said metallic shield disposed within said loop to said ground member.

22. The method of claim 20 wherein said termination portion and each of said loops form an opening that is dimensioned to generally encircle said exposed portion of said metallic shield of one of said cables disposed within said loop.

23. The method of claim 20 wherein at least one additional cable is to be terminated to said ground member, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and wherein said method further includes positioning said additional exposed portion of said additional metallic shield of said additional cable within one of a pair of additional loops extending from said ground member on a side of said ground member opposite to the side from which said loops extend, said additional loop being configured in a generally arc-shaped configuration to define a cable receiving area and bonding said additional exposed portion of said additional metallic shield of said additional cable to said ground member while said additional exposed portion is positioned in one of said additional loops.

24. The method of claim 23 wherein said termination portion is an elongated ground plate and said pair of loops are spaced longitudinally along said ground plate with respect to said pair of additional loops.

25. The method of claim 23 wherein said termination portion and each of said loops form an opening that is dimensioned to generally encircle said exposed portion of said metallic shield of each of said cables and wherein said termination portion and at least one of said additional loops forms an opening that is dimensioned to generally encircle said additional exposed portion of said additional metallic shield of said additional cable.

26. The method of claim 23 wherein each of said loops includes a slot used in bonding said metallic shield disposed within said loop to said ground member and wherein each of said additional loops includes an additional slot used in bonding said additional metallic shield disposed within said additional loop to said ground member.

* * * * *